US008358182B2

(12) United States Patent
Kouki et al.

(10) Patent No.: US 8,358,182 B2
(45) Date of Patent: Jan. 22, 2013

(54) DUPLEXER FOR INTEGRATION IN COMMUNICATION TERMINALS

(75) Inventors: Ammar Kouki, Montreal (CA); Ahmed El-Zayat, St. Laurent (CA)

(73) Assignee: Ecole de Technologie Superieure, Montreal, Quebec (CA)

( * ) Notice: Subject to any disclaimer, the term of this patent is extended or adjusted under 35 U.S.C. 154(b) by 473 days.

(21) Appl. No.: 12/700,580

(22) Filed: Feb. 4, 2010

(65) Prior Publication Data

US 2011/0032050 A1 Feb. 10, 2011

Related U.S. Application Data

(60) Provisional application No. 61/150,212, filed on Feb. 5, 2009.

(51) Int. Cl.
*H01P 1/213* (2006.01)
*H01P 1/203* (2006.01)

(52) U.S. Cl. ..... 333/134; 333/204

(58) Field of Classification Search ..... 333/132, 333/134, 204, 202
See application file for complete search history.

(56) References Cited

U.S. PATENT DOCUMENTS 3,728,731 A 4/1973 Choi et al.
4,963,843 A 10/1990 Peckham
5,151,670 A 9/1992 Blair et al.
5,448,209 A 9/1995 Hirai et al.
5,963,115 A 10/1999 Holleboom et al.
6,163,237 A 12/2000 Toda et al.
6,169,465 B1 1/2001 Kim et al.
6,549,095 B2 4/2003 Tsukamoto et al.
6,756,865 B2 * 6/2004 Saito et al. ..... 333/134
6,801,106 B2 10/2004 Ono et al.
6,965,284 B2 11/2005 Maekawa et al.
7,012,481 B2 3/2006 Maekawa et al.
2004/0189533 A1 9/2004 Yamanaka et al.
2006/0091979 A1 * 5/2006 Chang et al. ..... 333/204

* cited by examiner

*Primary Examiner* — Stephen Jones
(74) *Attorney, Agent, or Firm* — Norton Rose Canada LLP

(57) ABSTRACT

There is described a duplexer comprising: a dielectric substrate having a circuit-receiving surface and an opposite surface; a ground structure deposited on the circuit-receiving surface or the opposite surface; a first filter connectable to a first terminal and having a first frequency bandpass; a second filter connectable to a second terminal and having a second frequency bandpass different from the first frequency bandpass, the first filter and the second filter each having at least one filter section deposited on the circuit-receiving surface; and an uncovered coupling circuit connectable to a third terminal and deposited on the circuit-receiving surface between the first filter and the second filter, the coupling circuit being spaced apart from the first and second filter by a coupling gap and configured for electromagnetically coupling the first filter and the second filter together.

20 Claims, 14 Drawing Sheets

DUPLEXER FOR INTEGRATION IN COMMUNICATION TERMINALS

CROSS-REFERENCE TO RELATED APPLICATIONS

The present application claims priority under 35 USC§119 (e) of U.S. Provisional Patent Application bearing Ser. No. 61/150,212, filed on Feb. 5, 2009, the contents of which are hereby incorporated by reference.

TECHNICAL FIELD

The present invention is related to the field of telecommunications, and more particularly to the design of duplexers for use in communication terminals.

BACKGROUND

A duplexer is a circuit that allows a transmitter and a receiver to share the same antenna to simultaneously transmit and receive signals at closely spaced frequencies. A duplexer usually comprises a first filter (i.e. the transmission filter) connected to a transmitter and a second filter (i.e. the reception filter) connected to a receiver. The passband of the transmission/reception filter is adjusted to let the transmission/reception signal pass through while blocking the propagation of the reception/transmission signal. Typically, an interconnection circuit physically connects both filters to the antenna.

The interconnection circuit usually comprises two transmission lines. The first transmission line physically connects both filters and the second transmission line connects the first transmission line to the antenna. Duplexers are commonly integrated into wireless communication terminals. However, the integration becomes problematic when the size of the duplexer is significant compared to that of the terminal.

Therefore, there is a need for an improved duplexer and an improved method of sharing an antenna between a receiver and a transmitter.

SUMMARY

The present device uses electromagnetic field coupling to achieve a size reduction with respect to conventional microstrip duplexers. Microstrip or co-planar technologies may be used for fabrication.

In accordance with a first broad aspect, there is provided a duplexer comprising: a dielectric substrate having a circuit-receiving surface and an opposite surface; a ground structure deposited on one of the circuit-receiving surface and the opposite surface; a first filter connectable to a first terminal and having a first frequency bandpass; a second filter connectable to a second terminal and having a second frequency bandpass different from the first frequency bandpass, the first filter and the second filter each having at least one filter section deposited on the circuit-receiving surface; and an uncovered coupling circuit connectable to a third terminal and deposited on the circuit-receiving surface between the first filter and the second filter, the coupling circuit being spaced apart from the first and second filter by a coupling gap and configured for electromagnetically coupling the first filter and the second filter together in order to electromagnetically couple a first quasi-transverse electromagnetic (TEM) wave signal having a first frequency within the first frequency bandpass between the uncovered coupling circuit and the first filter, and a second quasi-TEM wave signal having a second frequency within the second frequency bandpass between the uncovered coupling circuit and the second filter.

In one embodiment, the ground structure may comprise a ground layer deposited on the opposite surface so that the uncovered coupling circuit corresponds to a microstrip coupling circuit.

In another embodiment the ground structure may be deposited on the circuit-receiving surface so that the uncovered coupling circuit corresponds to a coplanar waveguide coupling circuit.

In one embodiment, the uncovered coupling circuit may an uncovered strip line having a substantially uniform width.

In another embodiment, the uncovered coupling circuit may comprise a first uncovered strip line having a first width connected to a second uncovered strip line having a second width different from the first width. The coupling circuit may further comprise an uncovered and tapered strip line positioned between the first strip line and the second strip line.

In a further embodiment, the coupling circuit may comprise an uncovered and broken strip line.

In one embodiment, the first filter and the second filter may comprise uncovered filters deposited on the circuit-receiving surface.

In one embodiment, the dielectric substrate may comprise at least a bottom layer and a top layer, and the first filter and the second filter may each comprise at least an uncovered resonator deposited on top of the top layer and a buried resonator disposed between the bottom layer and the top layer.

In one embodiment, the duplexer may further comprise a first port matching circuit connected to the first filter and a second port matching circuit connected to the second filter.

In one embodiment, at least one of the first filter and the second filter may comprise an hairpin filter. In the same or an alternate embodiment, at least one of the first filter and the second filter may comprise a folded half-wave resonator filter.

In accordance with a second broad aspect, there is provided a method of sharing an antenna between a receiver and a transmitter comprising: receiving an antenna quasi-TEM wave signal having a first frequency from the antenna; propagating the antenna quasi-TEM wave signal in an electromagnetic coupling circuit; electromagnetically coupling the antenna quasi-TEM wave signal to a first filter having a first frequency bandpass comprising the first frequency, thereby obtaining a filtered antenna signal; propagating the filtered antenna signal to the receiver; receiving, from the transmitter, a transmitter signal having a second frequency different from the first frequency; propagating the transmitter signal in a second filter having a second frequency bandpass different from the first frequency bandpass and comprising the second frequency, thereby obtaining a transmitter quasi-TEM wave signal; electromagnetically coupling the transmitter quasi-TEM wave signal to the electromagnetic coupling circuit; and propagating the transmitter quasi-TEM wave signal to the antenna.

In one embodiment, the filtered antenna signal and the transmitter signal may be quasi-TEM. In another embodiment, the filtered antenna signal and the transmitter signal may be TEM.

In accordance with a third broad aspect, there is provided a method of fabricating a duplexer comprising: providing a dielectric substrate having a circuit-receiving surface and an opposite surface; forming a ground structure on one of the circuit-receiving surface and the opposite surface; forming, in the dielectric substrate, a first filter connectable to a first terminal and having a first frequency bandpass, and a second filter connectable to a second terminal and having a second frequency bandpass different from the first frequency bandpass, the first filter and the second filter each having at least one filter section deposited on the circuit-receiving surface; and depositing an uncovered coupling circuit connectable to a third terminal on the circuit-receiving surface between the first filter and the second filter, the coupling circuit being spaced apart from the first and second filter by a coupling gap and configured for electromagnetically coupling the first filter and the second filter together in order to electromagnetically couple a first quasi-TEM wave signal having a first frequency within the first frequency bandpass between the uncovered coupling circuit and the first filter, and a second quasi-TEM wave signal having a second frequency within the second frequency bandpass between the uncovered coupling circuit and the second filter.

In one embodiment, the step of forming the ground structure may comprise depositing a ground layer on the opposite surface. In another embodiment, the step of forming the ground structure may comprise depositing at least one ground strip on the circuit-receiving surface.

In one embodiment, the step of forming the first filter and the second filter may comprises depositing a first uncovered filter and a second uncovered filter on the circuit-receiving surface.

In one embodiment, the step of providing the dielectric substrate may comprise providing a multilayered substrate having at least a bottom layer and a top layer, and the step of forming the first filter and the second filter may comprise, for each one of the first filter and the second filter, depositing an uncovered resonator deposited on top of the top layer and forming a buried resonator between the bottom layer and the top layer.

BRIEF DESCRIPTION OF THE DRAWINGS

Further features and advantages of the present invention will become apparent from the following detailed description, taken in combination with the appended drawings, in which.

It will be noted that throughout the appended drawings, like features are identified by like reference numerals.

DETAILED DESCRIPTION

Figure 1:
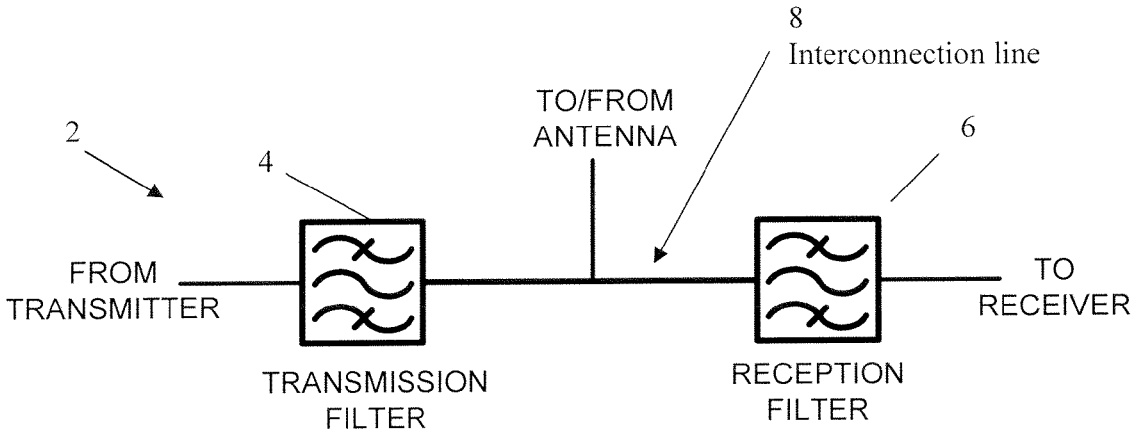
FIGURE 1 (PRIOR ART)
FIG. 1 illustrates a duplexer according to the prior art.

FIG. 1 illustrates a duplexer 2 according to the prior art. The duplexer 2 includes a transmission filter 4 and a reception filter 6 which are physically interconnected by an interconnection line 8. The interconnection line 8 is a quarter-wavelength transmission line which ensures a proper transformation of impedance between the transmitter 4 and the receiver 6. Hence, the transmission signal propagates from the transmitter 4 to the antenna but not to the receiver 6, and the reception signal propagates from the antenna to the receiver 6 but not to the transmitter 4. However, the interconnection line 8 is responsible in large part for the overall size of the duplexer 2.

In accordance with an embodiment of the present device, a duplexer is achieved in microstrip technology. The microstrip technology consists in depositing thin-film strip conductive components on one side of a substantially flat dielectric substrate, with a thin-film ground-plane conductor on the other side of the substrate. Any deposition technique or etching technique known by a person skilled in the art can be used to fabricate the duplexer. The conductive components are deposited on a same surface of the dielectric substrate so as to be coplanar, thereby forming a single layer or monolayer. The conductive components comprise two filters and a matching circuit therebetween. The matching circuit is spaced apart from the filters by a gap. The conducting components may further comprise connectors to connect the duplexer to terminals and/or port impedance matching circuits.

In accordance with another embodiment, the duplexer is achieved in coplanar waveguide technology. The coplanar waveguide technology consists in depositing both conductive components and a ground plane on a same side of a dielectric substrate. The conductive components and the ground plane are coplanar, thereby forming a single layer or monolayer deposited on the dielectric substrate. The ground plane may comprise several ground strip segments which are spaced apart from the conductive components by a gap. The conductive components comprise two filters and a matching circuit therebetween. The matching circuit is spaced apart from the filters by a gap. The conducting components may further comprise connectors to connect the duplexer to terminals and/or port impedance matching circuits.

In an embodiment, the duplexer uses the coupling of electromagnetic fields to interconnect the two filters. A structure that enables electromagnetic coupling of the filters is provided as a matching circuit for the interconnection of the transmission and reception filters.

Figure 2A:
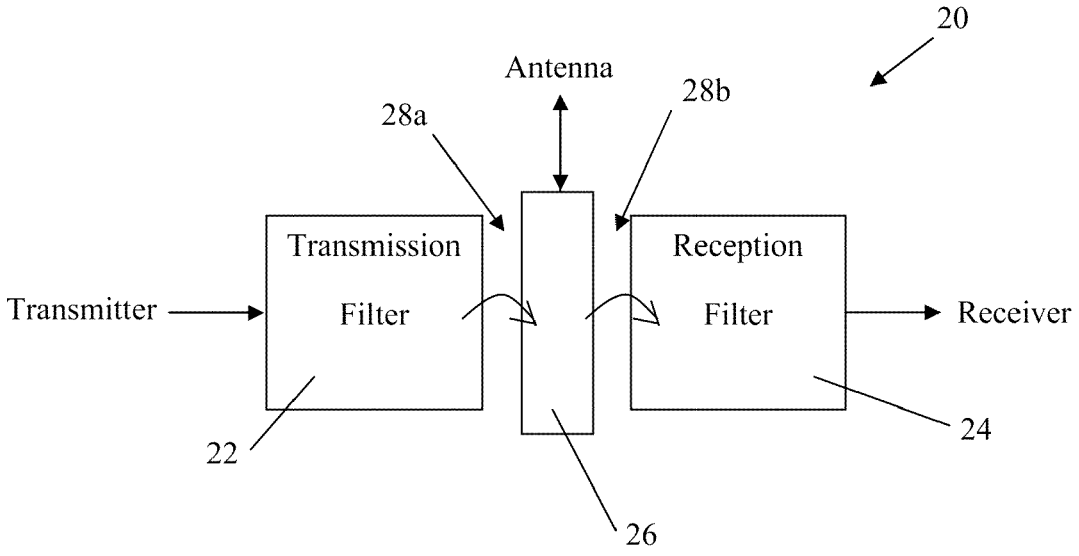
FIG. 2A is a block diagram of a duplexer, in accordance with one embodiment.

FIG. 2A schematically illustrates one embodiment of a duplexer 20 used for sharing an antenna between a transmitter and a receiver. The duplexer 20 comprises a transmission filter 22 connectable to a transmitter, a reception filter 24 connectable to a receiver and a coupling circuit 26 connectable to an antenna. The filters 22 and 24 and the coupling circuit 26 are not physically interconnected. A gap 28*a* physically separates the coupling circuit 26 from the transmission filter 22, and a gap 28*b* physically separates the coupling circuit 26 from the reception filter 24. The duplexer 20 exploits the direct coupling between the filters 22 and 24 to achieve the impedance transformation required. The characteristics of the transmission filter 22, the reception filter 24, the coupling circuit 26 and the gaps 28*a* and 28*b* are chosen to achieve the direct electromagnetic coupling and the impedance matching or transformation between the coupling circuit 26, the transmission filter 22, and the reception filter 24.

The transmission filter 22 has a transmission bandpass which is different from the reception bandpass of the reception filter 24. Signals having a frequency within the transmission bandpass can be transmitted between the transmitter and the antenna but not between the receiver and the antenna. Signals having a frequency within the reception bandpass can be transmitted between the antenna and the receiver but not between the transmitter and the antenna.

The duplexer 20 is achieved in microstrip or coplanar waveguide technology so that quasi-Transverse Electromagnetic (TEM) wave signals propagate therein. For example, a quasi-TEM wave signal having a signal frequency is received from the transmitter by the transmission filter 22. Because the signal frequency of the quasi-TEM wave signal is within the transmission bandpass of the transmission filter 22, the quasi-TEM wave signal propagates through the transmission filter 22. The quasi-TEM wave signal then propagates from the transmission filter 22 in the coupling circuit 26 via electromagnetic coupling. Because the signal frequency of the quasi-TEM wave signal is not within the reception bandpass of the reception filter 24, the quasi-TEM wave signal cannot propagate in the reception filter 24. The quasi-TEM wave signal then propagates to the antenna connected to the coupling circuit 26.

In another example, a quasi-TEM wave signal having a signal frequency is received by the antenna and propagates to the coupling circuit 26. Because of the impedance matching between the coupling circuit 26 and the reception filter 24, the quasi-TEM wave signal is electromagnetically coupled to the reception filter 24. Because the signal frequency of the quasi-TEM wave signal is within the reception bandpass of the reception filter 24, the quasi-TEM wave signal is transmitted to the receiver. Because the signal frequency of the quasi-TEM wave signal is not within the transmission bandpass of the transmission filter 22, the quasi-TEM wave signal cannot propagate in the transmission filter 22.

In one embodiment, the filters 22 and 24 are narrow bandpass filters. For example, the bandwidth of the filter bandpass may correspond to 5% of the resonance frequency of the filter.

In one embodiment, the duplexer 20 exploits the direct coupling between narrow band pass filters to achieve the impedance transformation required. This design enables miniaturization of the duplexer and adjustment of its skirt characteristics (Zero position).

Figure 2B:
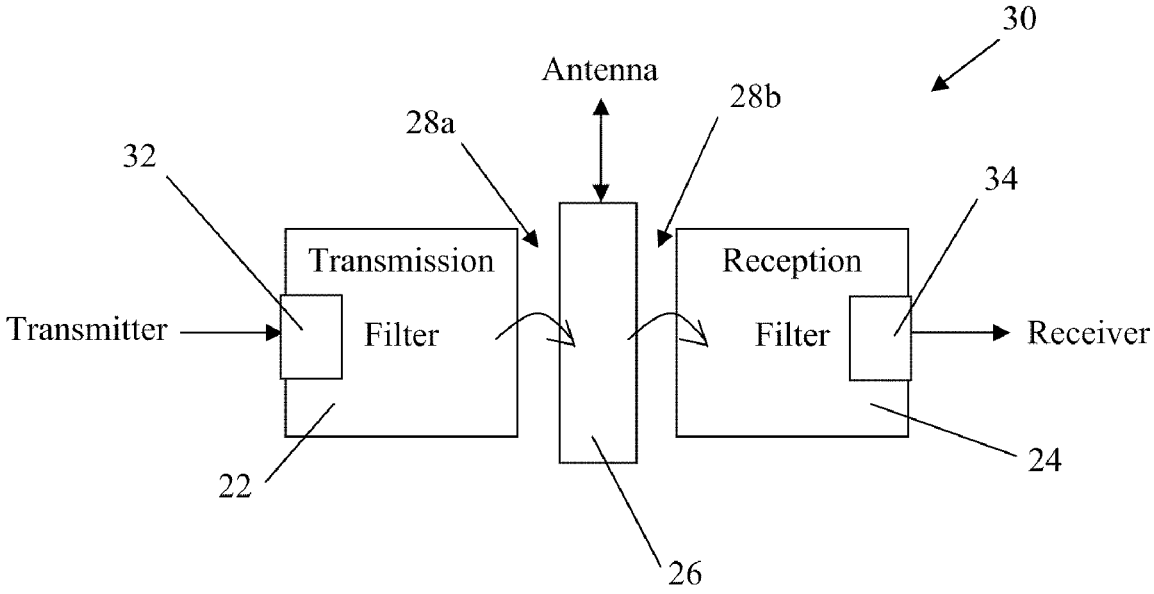
FIG. 2B is a block diagram of the duplexer of FIG. 1 comprising port matching circuit, in accordance with one embodiment.

FIG. 2B schematically illustrates one embodiment of a duplexer 30 used for connecting an antenna to a receiver and a transmitter. The duplexer 30 comprises the transmission filter 22, the reception filter 24, and the coupling circuit 26 illustrated in FIG. 2A. The duplexer 30 further comprises two port matching circuits, namely the port matching circuit 32 physically connected to the transmission filter 22 and the port matching circuit 34 connected to the reception filter 24 for improving the impedance matching between the transmitter and the transmission filter 22, and between the reception filter 24 and the receiver, respectively.

In one embodiment, the use of single-layer microstrip technology or coplanar waveguide technology operating with quasi-TEM modes facilitates the integration of the duplexer in planar circuit configurations.

It should be understood that the impedance transformation is achieved through electromagnetic coupling between the filters without a direct physical connection between them. The coupling structure is part of the duplexer and may be designed simultaneously with the filters. This results in size reduction given the absence of any physical interconnection line between the two filters. Duplexers according to the present device may have a footprint of only 25 $mm^2$, which represents a size reduction of 40% over the classical approach using quarter-wavelength interconnection lines. It should be understood that the size of the duplexer may vary as a function of design parameters.

Figure 3A:
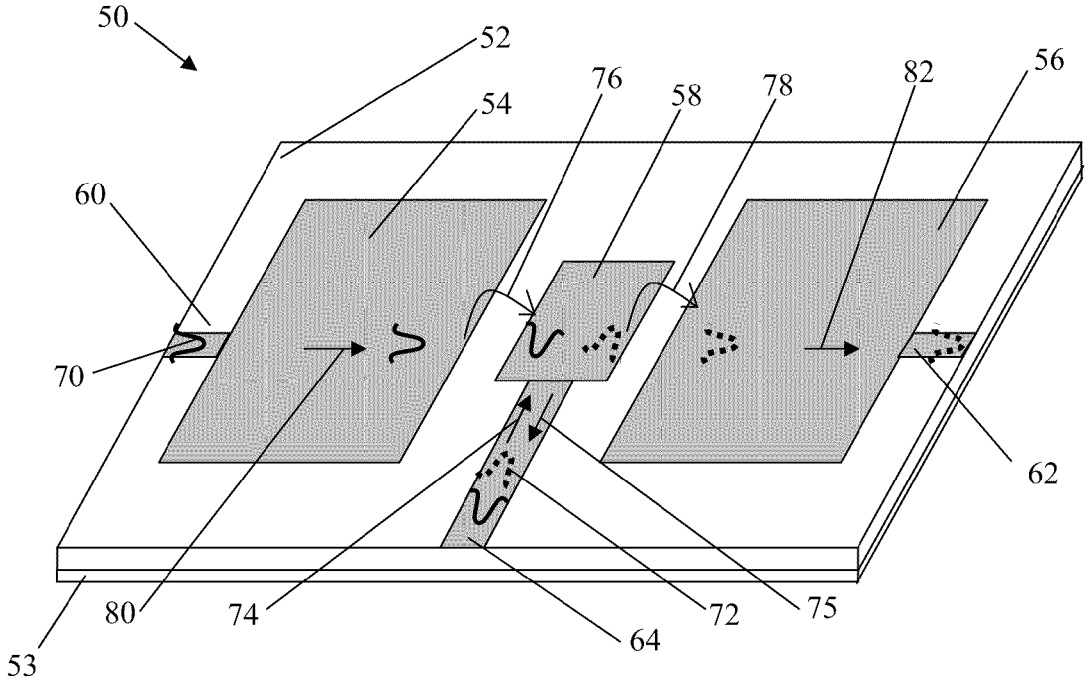
FIG. 3A is a perspective view a layout of a microstrip duplexer, in accordance with one embodiment.

FIG. 3A illustrates a perspective view of one embodiment of a duplexer 50. The duplexer 50 has a microstrip structure. The duplexer 50 comprises a dielectric substrate 52. The conductive components are positioned on the top side of the dielectric substrate 52 and a ground plane 53 is present on the bottom side of the dielectric substrate 52. A first filter 54 and a second filter 56 made of conductive material are present on the top side of the dielectric substrate 52 and can be connected to a receiver or a transmitter using the conductive connection lines 60 and 62, respectively. A matching circuit 58 is located between the filters 54 and 56. The matching circuit 58 is made of conductive material and is connected to an antenna through the connection line 64. The matching circuit 58 realizes the impedance transformation and the electromagnetic coupling between the filters 54 and 56.

If the passband of the filter 54 is adapted to the frequency $\nu_1$ of the transmitter, then a transmission signal 70 at frequency $\nu_1$ reaches the connection line 60. From the line 60, the transmission signal 70 propagates along the filter 54 according to arrow 80. The transmission signal is electromagnetically coupled to the matching circuit 58 as illustrated by arrow 76. The transmission signal propagates from the matching circuit 58 to the connection line in the direction of arrow 75 and is directed towards the antenna. A reception signal 72 at frequency $\nu_2$ is received by the duplexer 50 and propagates along the connection line 64 according to the direction of arrow 74 and the matching circuit 58. If the frequency $\nu_2$ of the reception signal 72 falls within the passband of the filter 56, the reception signal 72 is electromagnetically coupled to the filter 56 and propagates in the direction of arrow 82. Finally, the reception signal is directed towards the receiver using the connection line 62. As the filters 54 and 56 have different passbands, the transmission signal 70 cannot reach the receiver and the reception signal 72 cannot reach the transmitter.

While in the present description, the signal 70 propagates from the connection line 60 to the connection line 64 and the signal 72 propagates from the transmission line 64 to the transmission line 62, it should be understood that the signal 70 may propagate from the connection line 64 to the connection line 60 and the signal 72 may propagate from the transmission line 62 to the transmission line 64. Alternatively, the connection lines 60 and 62 may be both connected to transmitters emitting signals having different frequencies. The signals coming from the connection lines 60 and 62 are combined by electromagnetic coupling into the matching circuit 58 and they exit the duplexer 50 by the connection line 64 connected to a terminal.

In another embodiment, two signals having different frequencies are received by the connection line 64 and propagate into the matching circuit 58. Each signal has a frequency corresponding to the frequency of one filter so that one signal is electromagnetically coupled in the filter 54 and the other signal is coupled into the filter 56. The signals are directed towards terminals connected to connection lines 60 and 62.

The use of the electromagnetic field coupling in a microstrip structured duplexer or a coplanar waveguide structured duplexer eliminates the use of lumped components to achieve the impedance matching between the filters and offers flexibility to the design. The present duplexer also eliminates the need for any via hole or grounding of any part of the components of the duplexer. The duplexer can be integrated with active devices on a Monolithic Microwave Integrated Circuit (MMIC) chip, for example.

Figure 3B:
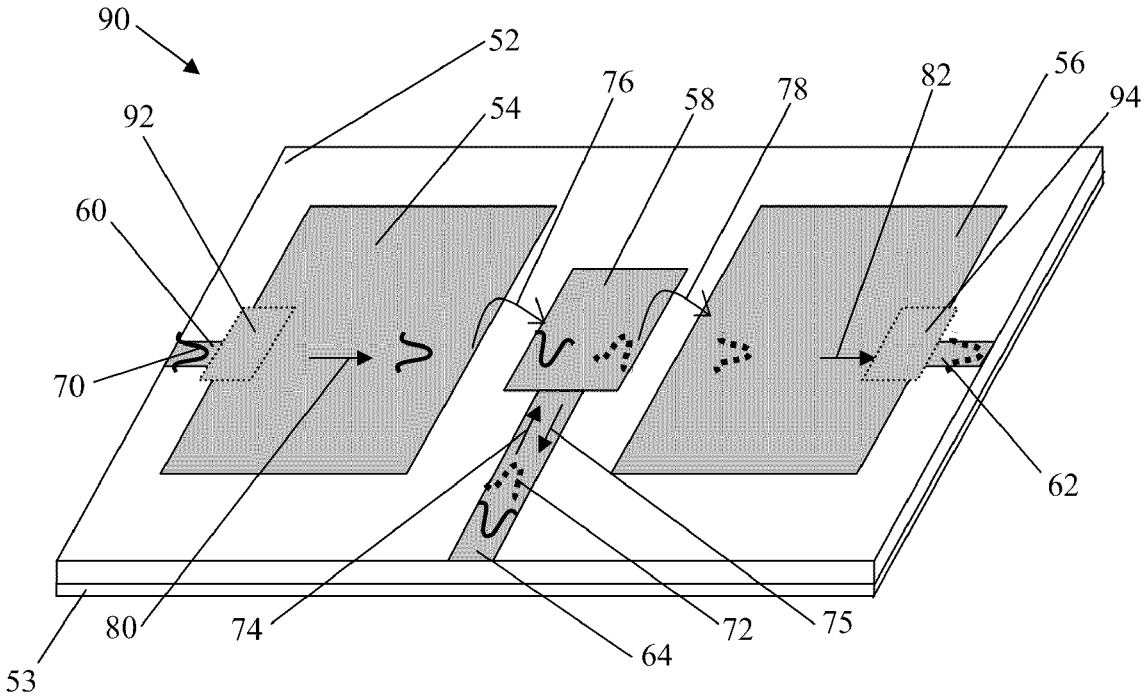
FIG. 3B is a perspective view of the layout of a microstrip duplexer of FIG. 3A comprising port matching circuits, in accordance with one embodiment.

FIG. 3B illustrates a perspective view of one embodiment of a duplexer 90. The duplexer 90 has a microstrip structure. The duplexer 90 comprises the dielectric substrate 52 having a top surface on which the filters 54 and 56, the coupling circuit 58, and the connection lines 60, 62, and 64 are deposited. The ground plane 53 is deposited on the bottom surface of the dielectric substrate 52. The duplexer 90 further comprises two port matching circuits 92 and 94 deposited on the top surface of the dielectric substrate 52. The port matching circuit 92 physically connects the filter 54 and the connection line 60 for improving impedance matching between the two. The port matching circuit 94 physically connects the filter 56 and the connection line 62 for improving the impedance matching between the two.

In one embodiment of the duplexer 50 or 90, the matching circuit 58 is an impedance transformation and electromagnetic coupling structure which comprises the connection 64 to the antenna. The structure can be made of two distinct parts or a single strip line.

Figure 4:
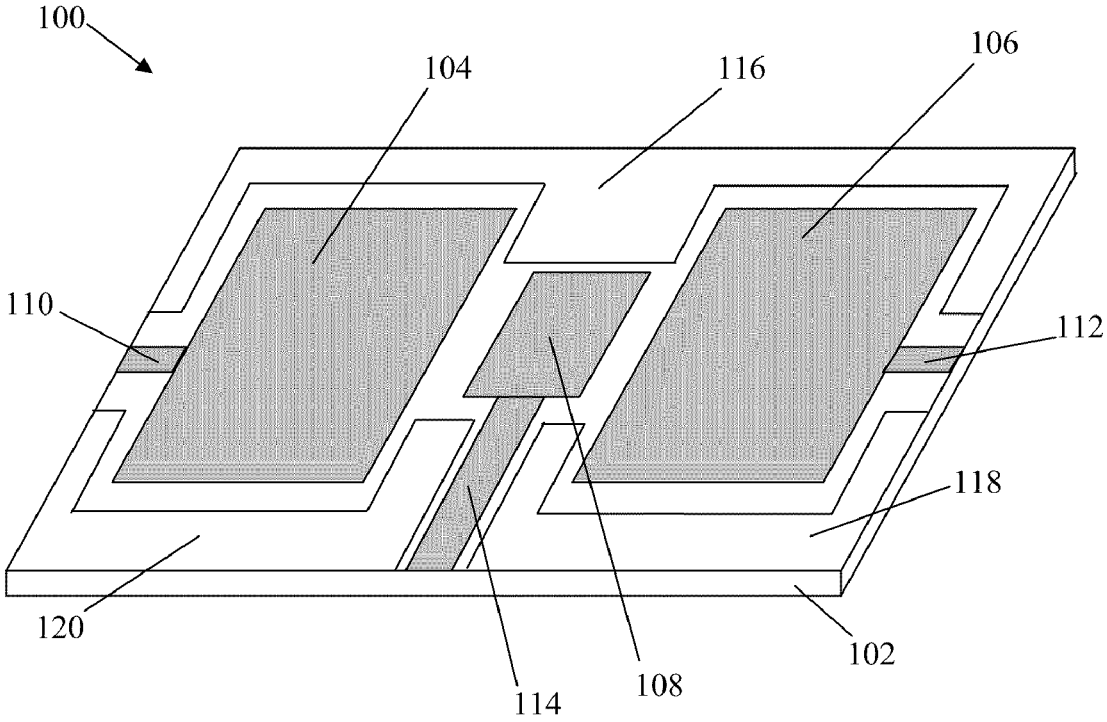
FIG. 4 is a perspective view of a layout of a coplanar waveguide duplexer, in accordance with one embodiment.

FIG. 4 illustrates one embodiment of a duplexer 100 achieved in coplanar waveguide technology. The duplexer 100 comprises a dielectric substrate 102 on which the duplexer structure and the ground structure are deposited. Contrary to the duplexers 50 and 90, the ground structure is deposited on a same surface of the dielectric substrate 102. The duplexer structure comprises a first filter 104, a second filter 106, a coupling circuit 108 therebetween, and three connection strip lines 110, 112, and 114 for connecting the previous elements to a respective terminal. The ground structure comprises three ground plates 116, 118, and 120 which surround the duplexer structure. The ground plates 116, 118, and 120 are spaced apart from the components of the duplexer structure by a gap.

It should be noted that the duplexer can be associated with terminals other than receivers, transmitters and antennas.

In one embodiment, the design of the first filter of the duplexer is independent of the design of the second filter. Therefore, a particular filter may be replaced by another filter without changing the design of the other elements of the duplexer. Each individual element becomes a building block in the design and is interchangeable.

Figure 5:
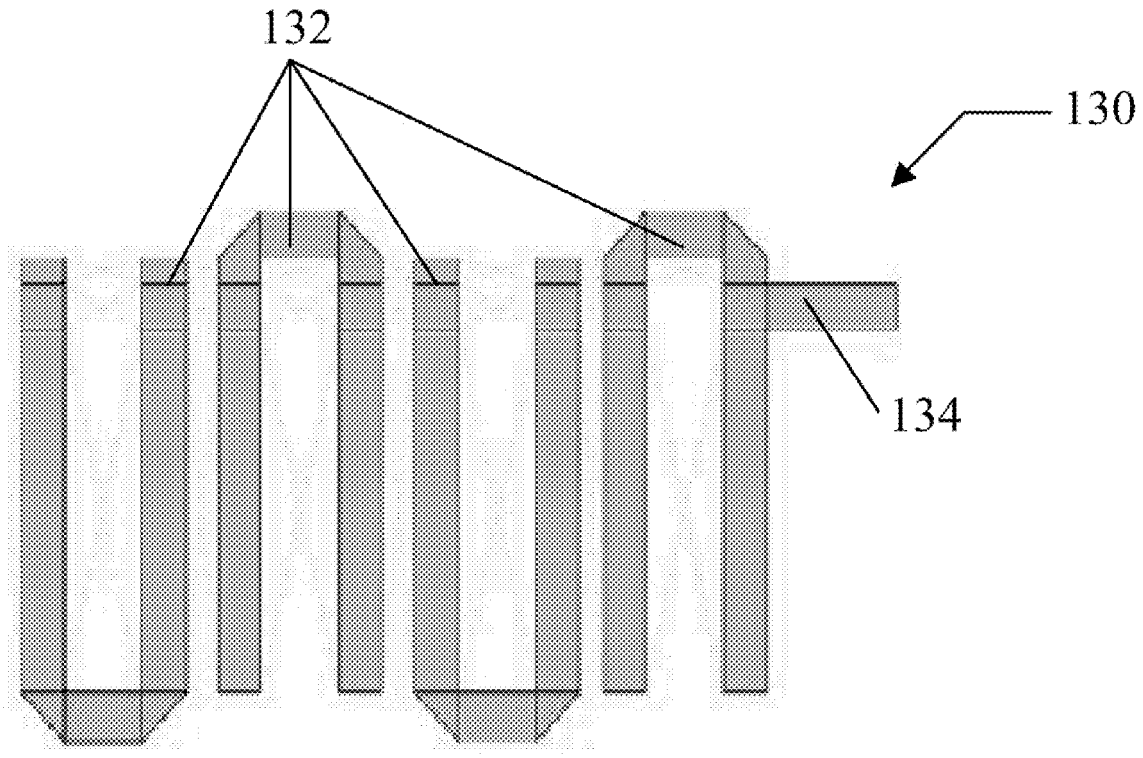
FIGURE 5 (PRIOR ART)
FIG. 5 is a schematic illustration of a microstrip filter to be used with the present duplexer, in accordance with one embodiment.

FIG. 5 illustrates a hairpin microstrip filter 130 that can be used in the present duplexer. The hairpin microstrip filter 130 is constituted of four hairpins resonators 132 and connected to a terminal by the connection line 134. While the filter 130 comprises four hairpins resonators 132, it should be understood that the number of hairpins is exemplary only.

It should also be understood that any adequate type of filter may be used for the first and second filters of the duplexer. For example, the filter can comprise at least one square loop resonator, at least one short-circuit quarter wave resonator, at least one folded half-wavelength resonator, or the like.

Figure 6A:
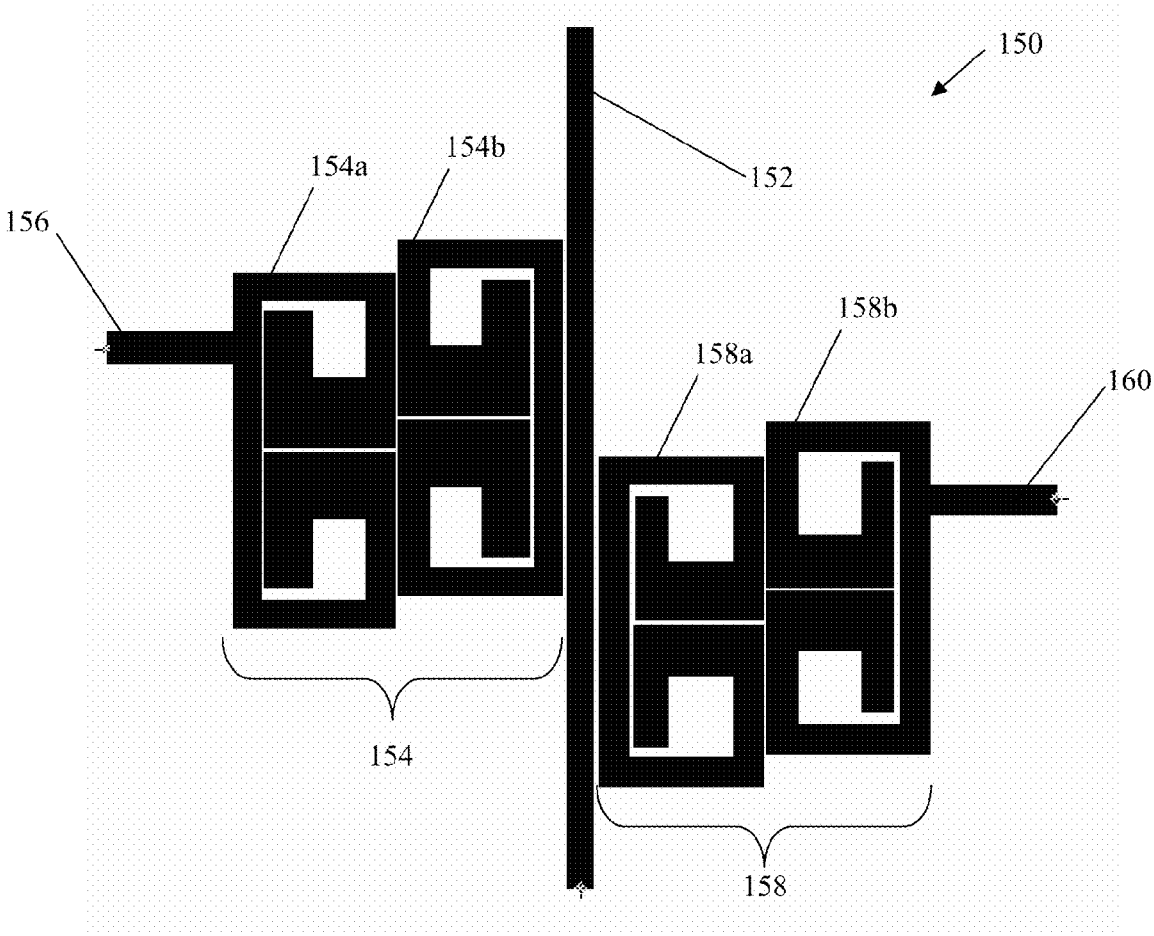
FIG. 6A schematically illustrates a duplexer comprising a line coupling circuit, in accordance with one embodiment.

FIG. 6A illustrates one embodiment of a duplexer 150 achieved in microstrip technology. The duplexer comprises a first filter 154, a second filter 158, and an impedance transformation and electromagnetic coupling structure 152 therebetween. The first and second filters 154 and 158 each comprise two folded half-wavelength resonators 154*a*, 154*b*, 158*a*, and 158*b* which are both deposited on top of a dielectric substrate to be co-planar. The impedance transformation and electromagnetic coupling structure 152 is constituted of a strip line which is spaced apart from the filters 154 and 158 by a gap. Connection lines 156 and 160 physically connect the filters 154 and 158 to a first terminal and a second terminal, respectively, while the strip line 152 is connected to a third terminal.

In one embodiment, the impedance transformation and electromagnetic coupling is achieved by adequately choosing the position of the filters 154 and 158 with respect to the line 152 and/or the width of the gap between the filter 154, 158 and the line 152.

In one embodiment, the position of the connection line 156 with respect to the filter 154 and the position of the connection line 160 with respect to the filter 158 are chosen to excite an adequate mode for the frequency to be transmitted in the respective filter 154, 158.

While the present description refers to a coupling circuit comprising a uniform and straight line 152, it should be understood that other embodiments are possible. For example, the coupling circuit may comprise a first strip line having a first width connected to a second strip line having a second and different width. The first and second filters may be positioned to substantially face the first and second line, respectively. The connection between the first and second lines may be abrupt. Alternatively, a tapered line may be used to connect the first and second lines. In the same or another embodiment, the coupling circuit may comprise a broken strip line comprising first and second sections misaligned to form an angle. The first and second filters are positioned to face the first and second sections, respectively. The first and second sections may have different widths.

Figure 6B:
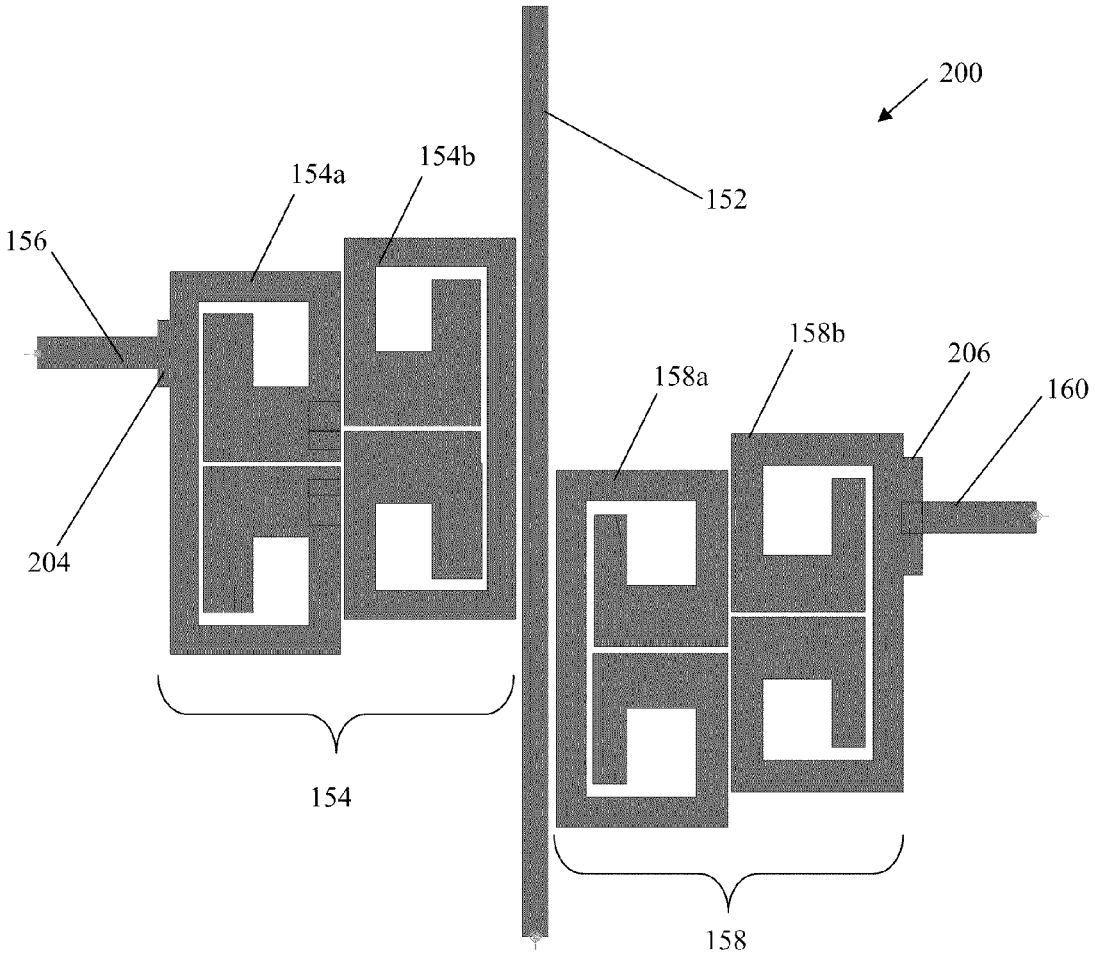
FIG. 6B schematically illustrates the duplexer of FIG. 6A further comprising port matching circuits, in accordance with one embodiment.

FIG. 6B illustrates one embodiment of a duplexer 200 connectable to three terminals and achieved in microstrip technology. The duplexer 200 comprises the filters 154 and 158, and the coupling circuit 152 illustrated in FIG. 6A. The duplexer 200 further comprises port matching circuits 204 and 206. The port matching circuits 204, 206 improve impedance matching between the filter 154 and the connection line 156, and between the filter 158 and the connection line 160, respectively.

While the present description refers to microstrip or coplanar waveguide filters, it should be understood that the filters may be fabricated in stripline technology as long as the coupling circuit is uncovered to electromagnetically couple quasi-TEM wave signals to the filters. In the case of a stripline transmitter filter, the stripline filter receives a TEM wave signal from the transmitter and transmits a quasi-TEM wave signal to the coupling circuit. In the case of a stripline receiver filter, the stripline filter receives a quasi-TEM wave signal from the coupling circuit and transmits a TEM wave signal to the receiver.

Taking the example of the duplexer 50 illustrated in FIG. 6A, the filters 154 and 158 may be fabricated in stripline technology. In this case, the dielectric substrate comprises at least a top layer deposited on top of a bottom layer. The line 152 and the folded half-wavelength resonators 154*b* and 158*a* are deposited on top of the top layer to be uncovered. The folded half-wavelength resonators 154*a* and 158*b* and the connection lines 156 and 160 are deposited on top of the bottom layer and sandwiched between the bottom and top layers.

Figure 7:
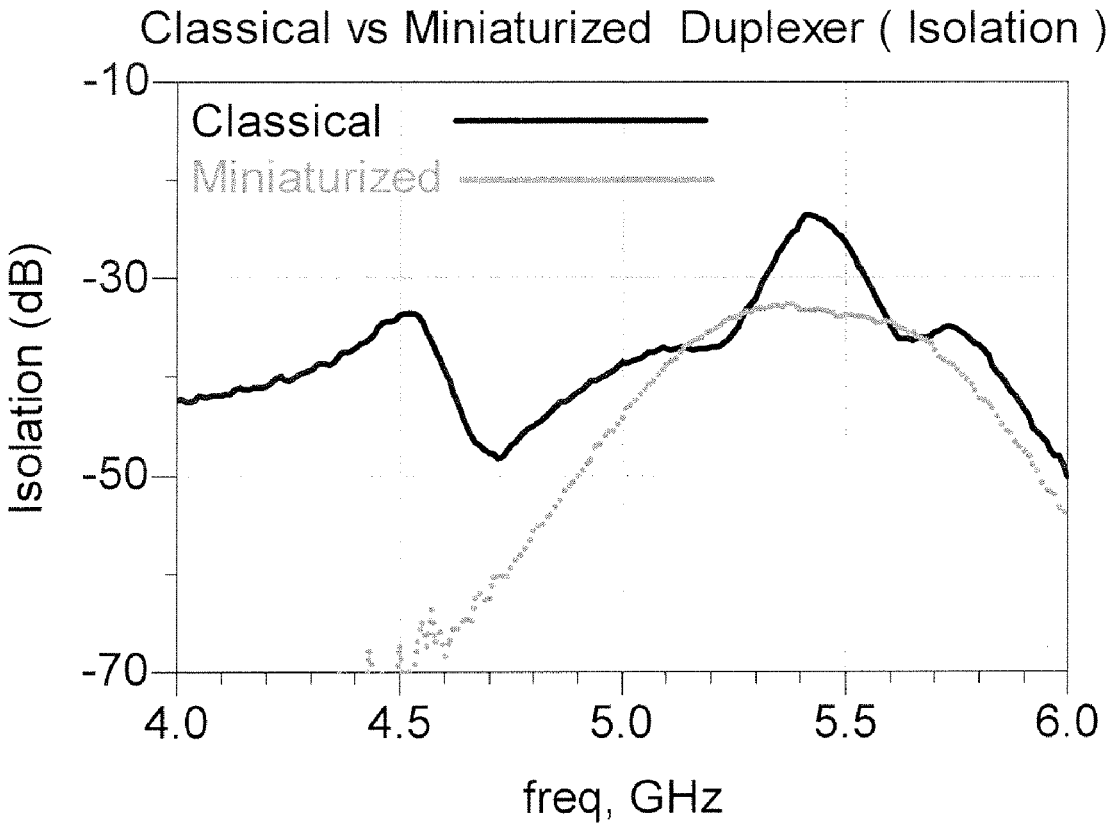
FIG. 7 is a graph of measured isolation for one embodiment of a duplexer and a prior art duplexer as a function of frequency, in accordance with one embodiment.
Figure 8:
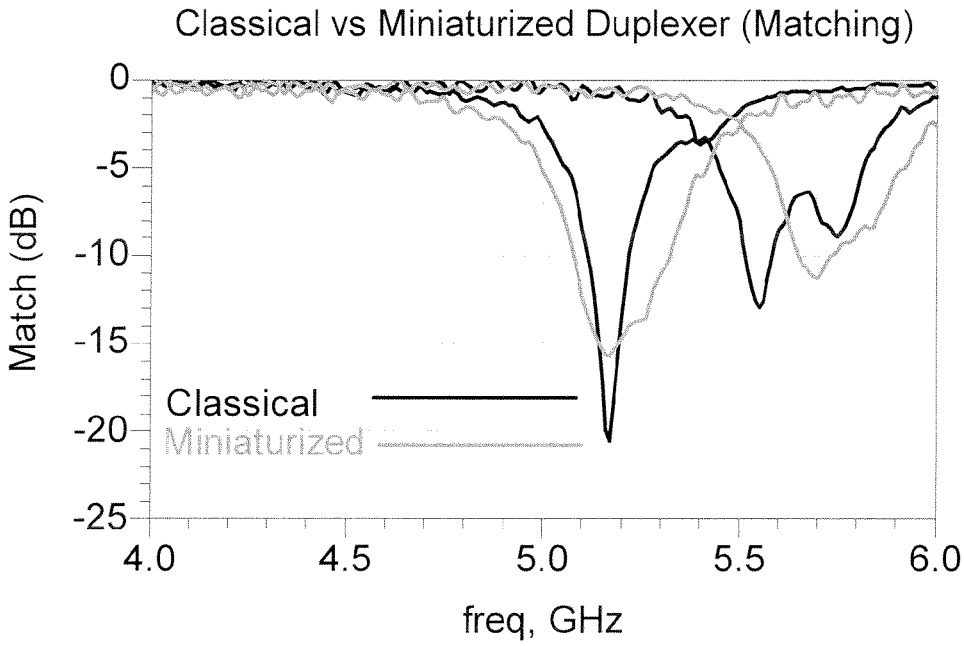
FIG. 8 is a graph of measured input matching for one embodiment of a duplexer and a prior art duplexer as a function of frequency, in accordance with one embodiment.
Figure 9:
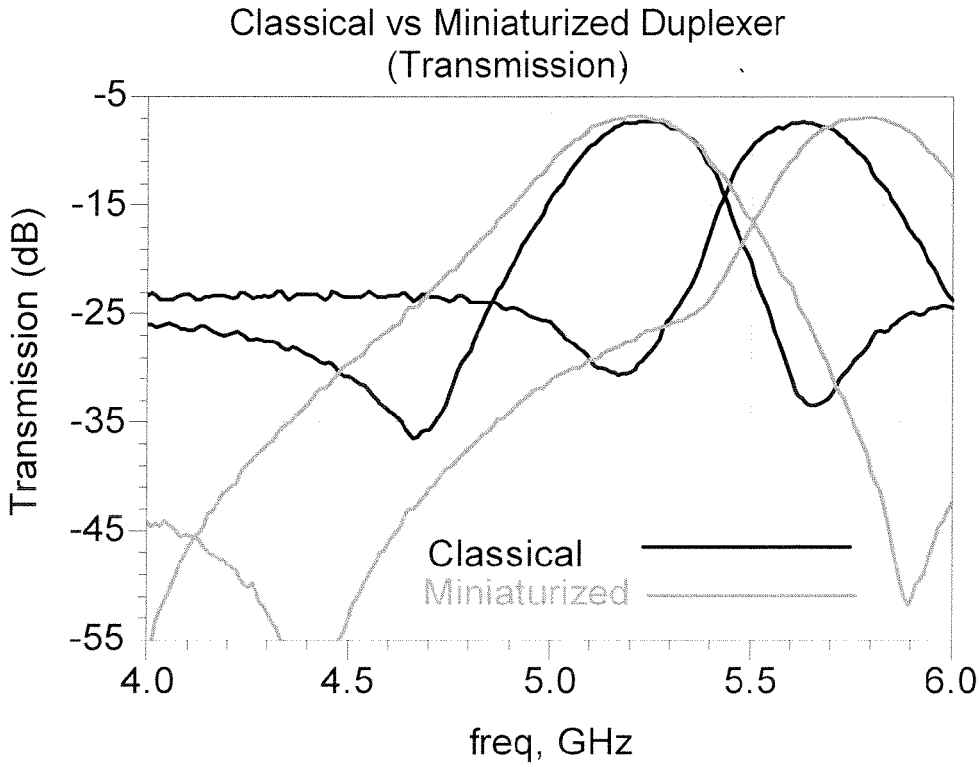
FIG. 9 is a graph of measured transmission for one embodiment of a duplexer and a prior art duplexer as a function of frequency.

FIGS. 7 to 9 illustrate experimental results for a classical duplexer and a miniaturized duplexer. The miniaturized duplexer corresponds to the duplexer illustrated in FIG. 6A achieved in microstrip technology. The classical duplexer corresponds to a duplexer of the prior art also achieved in microstrip technology, in which the filters 154 and 156 are physically interconnected by an interconnection line such as interconnection line 8 illustrated in FIG. 1.

FIG. 7 illustrates the measured isolations of an embodiment of the size-reduced or miniaturized duplexer and the classical duplexer according to the prior art. The isolation of the size-reduced duplexer/classical duplexer is about −35 dB/−38 dB at a frequency of 5.2 GHz and about −37 dB/−37 dB at a frequency of 5.7 GHz, respectively.

FIG. 8 illustrates the measured input impedance matching of the size-reduced duplexer and the classical duplexer according to the prior art. The size-reduced duplexer offers an adaptation of about −15 dB/−15 dB at 5.2 GHz and about −11 dB/−7 dB at 5.7 GHz, respectively.

FIG. 9 illustrates the measured transmissions of the size-reduced duplexer compared to that of the classical duplexer according to the prior art. At a frequency of 5.2 GHz, the transmission from the connection line 64 to the connection line 60 is equal to −4 dB and the transmission from the connection line 64 to the other connection line 62 is equal to −27 dB for the embodiment of the size-reduced duplexer, and the transmissions are equal to −4 dB and −31 dB, respectively, for the classical duplexer according to the prior art. At 5.7 GHz, the transmission from the connection line 64 to the connection line 60 is equal to −31 dB and the transmission from the connection line 64 to the other connection line 62 is equal to −4 dB for the embodiment of the size-reduced duplexer, in comparison to −31 dB and −4 dB, respectively, for the classical duplexer according to the prior art. FIGS. 5, 6 and 7 demonstrate that the size-reduced duplexer has comparable performances with respect to a classical duplexer according to the prior art.

Figure 10:
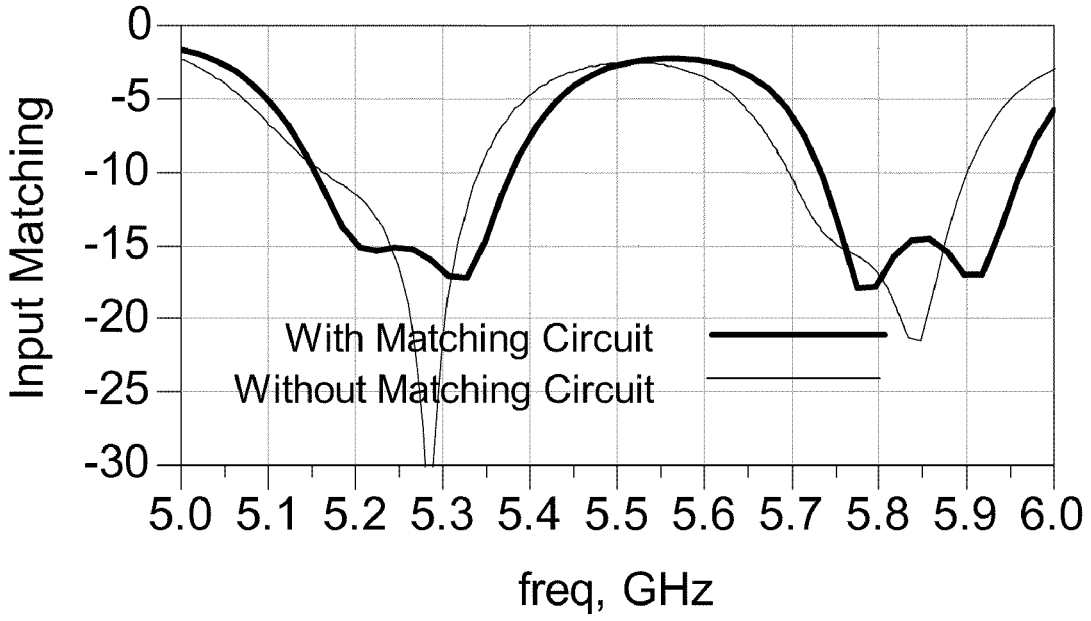
FIG. 10 is a graph of simulated input matching for a microstrip duplexer comprising no port matching circuit and a microstrip duplexer provided with port matching circuits as a function of frequency, in accordance with one embodiment.
Figure 11A:
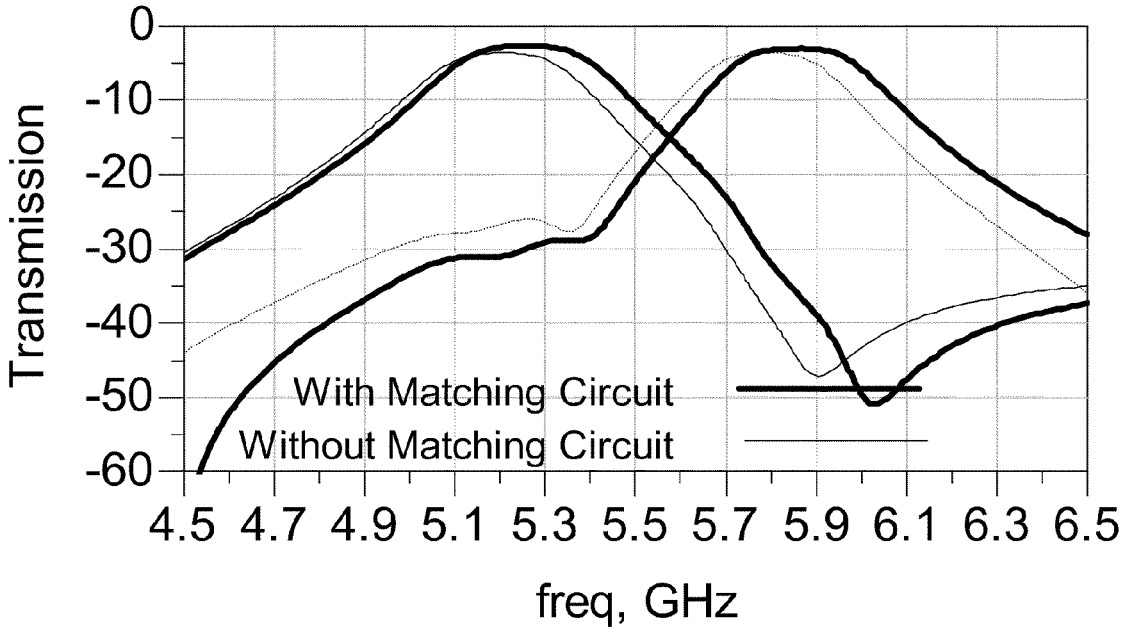
FIG. 11A is a graph of simulated transmission for a microstrip duplexer comprising no port matching circuit and a microstrip duplexer provided with port matching circuits as a function of the frequency, in accordance with one embodiment.
Figure 11B:
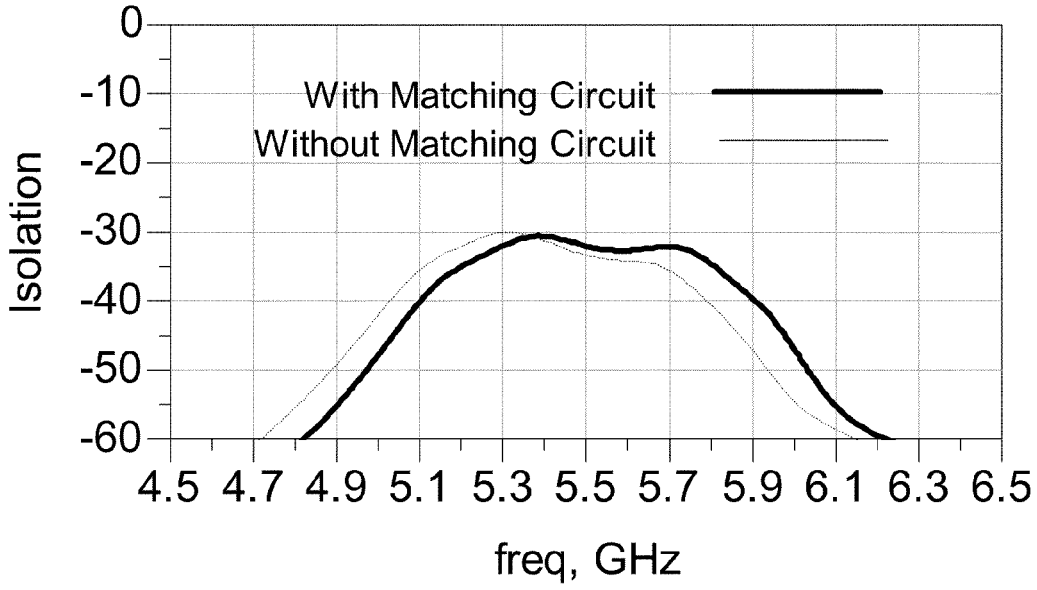
FIG. 11B is a graph of simulated isolation for a microstrip duplexer comprising no port matching circuit and a microstrip duplexer provided with port matching circuits as a function of the frequency, in accordance with an embodiment.

FIGS. 10 to 11B present comparative simulated results for a duplexer having port matching circuits and a duplexer having no port matching circuits. The duplexer comprising no port matching circuits correspond to the duplexer illustrated in FIG. 6A while the duplexer provided with port matching circuits corresponds to the duplexer illustrated in FIG. 6B.

FIG. 10 illustrates the effect of the input coupling circuit of the size-reduced duplexer on the input matching. The input matching is more uniform across the passband of the duplexer.

FIGS. 11A and 11B illustrate the transmission and isolation curves of a size-reduced duplexer with and without matching circuit according to the embodiment of FIG. 6. From FIGS. 11A and 11B, one can observe that the input matching circuit has a negligible effect on the other parameters. This facilitates the design efforts by providing an added degree of freedom at the designer's disposal.

Figure 12:
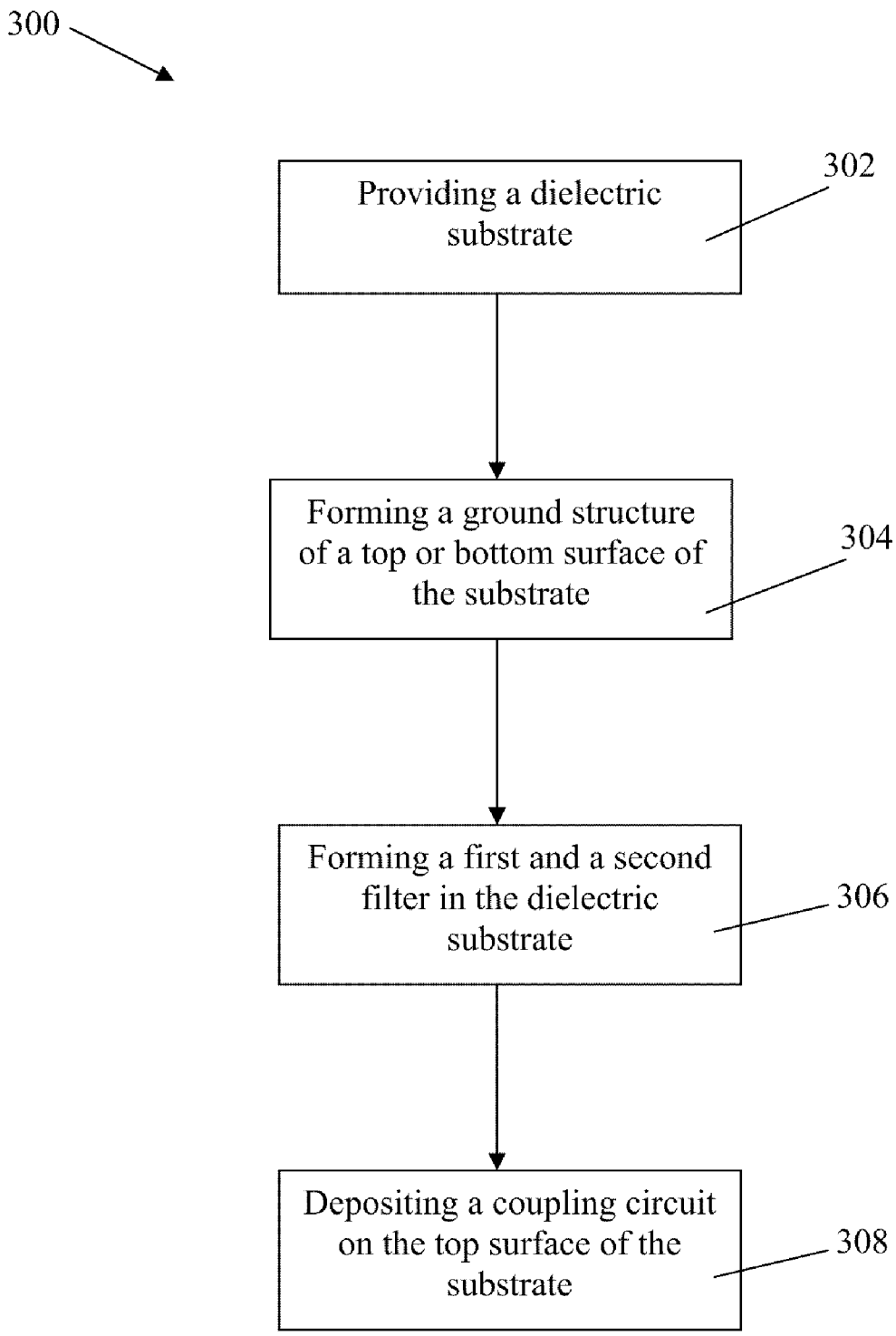
FIG. 12 is a flow chart illustrating a method for fabricating a duplexer, in accordance with one embodiment.

FIG. 12 illustrates one embodiment of a method 300 for fabricating the present duplexer. The first step 302 comprises providing a dielectric substrate having a circuit-receiving surface and an opposite surface. The dielectric substrate may comprise a single layer or a plurality of layers. The second step 304 comprises forming a ground structure on the circuit-receiving surface or the opposite surface. The next step 306 comprises forming a first and a second filter in the dielectric substrate. The first filter is connectable to a first terminal and has a first frequency bandpass. The second filter is connectable to a second terminal and has a second frequency bandpass different from the first frequency bandpass. Each filter has at least one uncovered filter section deposited on the circuit-receiving surface. The last step 308 comprises depositing an uncovered coupling circuit connectable to a third terminal on the component-receiving surface between the first filter and the second filter. The coupling circuit is spaced apart from the first and second filters by a coupling gap and configured for electromagnetically coupling the first and second filters together in order to electromagnetically couple a first quasi-TEM wave signal having a first frequency within the first frequency bandpass between the coupling circuit and the first filter, and a second quasi-TEM wave signal having a second frequency within the second frequency bandpass between the uncovered coupling circuit and the second filter.

In one embodiment, the whole duplexer is achieved in microstrip or coplanar waveguide technology. In this case, the step of forming the first and second filters comprises depositing the entire filters on the circuit-receiving surface of the dielectric substrate. If the duplexer is achieved in microstrip technology, the step of forming the ground structure comprises depositing a ground layer on the opposite surface of the substrate. If the duplexer is achieved in coplanar waveguide technology, the step of forming the ground structure comprises depositing at least one ground strip on the circuit-receiving surface.

In one embodiment in which the whole duplexer is achieved in coplanar waveguide technology, the filters, the coupling circuit and the ground structure are fabricated concurrently by depositing a conductive layer on the circuit-receiving surface of the dielectric substrate and etching the conductive layer to obtain the different components.

In one embodiment, the filters of the duplexer are achieved in stripline technology. In this case, a least a portion of each filter is uncovered and resides on the circuit-receiving surface of the substrate. For example, the filters each comprise at least two resonators: an uncovered resonator residing on the circuit-receiving surface and a buried resonator. Step 302 comprises providing a multilayered substrate having at least a bottom layer and a top layer, and step 306 consisting of forming the first and second filters comprises, for each one of the two filters, depositing the uncovered resonator on the top surface of the top layer and forming the buried resonator between the bottom layer and the top layer.

In one embodiment, a first conductive layer is deposited on top of the bottom layer and the first conductive layer is etched to form the two buried resonators and the connections for connecting the filters to their respective terminal. Then the top layer is deposited on top of the bottom layer so that the buried resonators and the connections are sandwiched between the top and bottom layers. A second conductive layer is deposited on top of the top layer and subsequently etched to form the coupling circuit, the uncovered resonators, and the connector for connecting the coupling circuit to its respective terminal.

It should be understood that any adequate positive or negative photomask may be used during the etching process and that adequate wet or dry etching can be performed.

In another embodiment, the steps of providing a photomask and etching the conductive layer are replaced by a micro-cutting step. In this case, material from the deposited conductive layer is removed from the substrate using any adequate micro-cutting method to define the components of the duplexer.

It should be understood that any adequate deposition method for depositing the ground layer and/or the conductive layer(s) may be used. Chemical vapor deposition (CVD), physical vapour deposition(PVD), and epitaxy are examples of deposition methods.

It should be understood that the dielectric substrate may be made from any adequate dielectric material such as silicon, ceramic, and the like. The filters, the coupling circuit, and the connectors may be made from any adequate conductive material such as gold, silver, copper, and the like.

The embodiments of the invention described above are intended to be exemplary only. The scope of the invention is therefore intended to be limited solely by the scope of the appended claims.

We claim:

1. A duplexer comprising:

a dielectric substrate having a circuit-receiving surface and an opposite surface;

a ground structure deposited on one of said circuit-receiving surface and said opposite surface;

a first filter connectable to a first terminal and having a first frequency bandpass;

a second filter connectable to a second terminal and having a second frequency bandpass different from said first frequency bandpass, said first filter and said second filter each having at least one filter section deposited on said circuit-receiving surface; and an uncovered coupling circuit connectable to a third terminal and deposited on said circuit-receiving surface between said first filter and said second filter, the coupling circuit being spaced apart from said first and second filter by a coupling gap and configured for electromagnetically coupling said first filter and said second filter together in order to electromagnetically couple a first quasi-transverse electromagnetic (TEM) wave signal having a first frequency within said first frequency bandpass between said uncovered coupling circuit and said first filter, and a second quasi-TEM wave signal having a second frequency within said second frequency bandpass between said uncovered coupling circuit and said second filter.

2. The duplexer as claimed in claim 1, wherein said ground structure comprises a ground layer deposited on said opposite surface so that said uncovered coupling circuit corresponds to a microstrip coupling circuit.

3. The duplexer as claimed in claim 1, wherein said ground structure is deposited on said circuit-receiving surface so that said uncovered coupling circuit corresponds to a coplanar waveguide coupling circuit.

4. The duplexer as claimed in claim 1, wherein said uncovered coupling circuit comprises a first uncovered strip line having a first width connected to a second uncovered strip line having a second width different from said first width.

5. The duplexer as claimed in claim 1, wherein said coupling circuit comprises an uncovered and broken strip line.

6. The duplexer as claimed in claim 1, wherein said first filter and said second filter comprise uncovered filters deposited on said circuit-receiving surface.

7. The duplexer as claimed in claim 1, wherein said dielectric substrate comprises at least a bottom layer and a top layer, and said first filter and said second filter each comprise at least an uncovered resonator deposited on top of said top layer and a buried resonator disposed between said bottom layer and said top layer.

8. The duplexer as claimed in claim 1, further comprising a first port matching circuit connected to said first filter and a second port matching circuit connected to said second filter.

9. The duplexer as claimed in claim 1, wherein at least one of said first filter and said second filter comprises an hairpin filter.

10. The duplexer as claimed in claim 1, wherein at least one of said first filter and said second filter comprises a folded half-wave resonator filter.

11. The duplexer as claimed in claim 1, wherein said uncovered coupling circuit comprises an uncovered strip line having a substantially uniform width.

12. The duplexer as claimed in claim 11, wherein said coupling circuit further comprises an uncovered and tapered strip line positioned between said first strip line and said second strip line.

13. A method of sharing an antenna between a receiver and a transmitter comprising:

receiving an antenna quasi-transverse electromagnetic (TEM) wave signal having a first frequency from said antenna;

propagating said antenna quasi-TEM wave signal in an electromagnetic coupling circuit;

electromagnetically coupling said antenna quasi-TEM wave signal to a first filter having a first frequency bandpass comprising said first frequency, thereby obtaining a filtered antenna signal;

propagating said filtered antenna signal to said receiver;

receiving, from said transmitter, a transmitter signal having a second frequency different from said first frequency;

propagating said transmitter signal in a second filter having a second frequency bandpass different from said first frequency bandpass and comprising said second frequency, thereby obtaining a transmitter quasi-TEM wave signal;

electromagnetically coupling said transmitter quasi-TEM wave signal to said electromagnetic coupling circuit; and propagating said transmitter quasi-TEM wave signal to said antenna.

14. The method as claimed in claim 13, wherein said filtered antenna signal and said transmitter signal are quasi-TEM.

15. The method as claimed in claim in claim 13, wherein said filtered antenna signal and said transmitter signal are TEM.

16. A method of fabricating a duplexer comprising:

providing a dielectric substrate having a circuit-receiving surface and an opposite surface;

forming a ground structure on one of said circuit-receiving surface and said opposite surface;

forming, in said dielectric substrate, a first filter connectable to a first terminal and having a first frequency bandpass, and a second filter connectable to a second terminal and having a second frequency bandpass different from said first frequency bandpass, said first filter and said second filter each having at least one filter section deposited on said circuit-receiving surface; and depositing an uncovered coupling circuit connectable to a third terminal on said circuit-receiving surface between said first filter and said second filter, the coupling circuit being spaced apart from said first and second filter by a coupling gap and configured for electromagnetically coupling said first filter and said second filter together in order to electromagnetically couple a first quasi-transverse electromagnetic (TEM) wave signal having a first frequency within said first frequency bandpass between said uncovered coupling circuit and said first filter, and a second quasi-TEM wave signal having a second frequency within said second frequency bandpass between said uncovered coupling circuit and said second filter.

17. The method as claimed in claim 16, wherein said forming said ground structure comprises depositing a ground layer on said opposite surface.

18. The method as claimed in claim 16, wherein said forming said ground structure comprises depositing at least one ground strip on said circuit-receiving surface.

19. The method as claimed in claim 16, wherein said forming said first filter and said second filter comprises depositing a first uncovered filter and a second uncovered filter on said circuit-receiving surface.

20. The method as claimed in claim 16, wherein said providing said dielectric substrate comprises providing a multi-layered substrate having at least a bottom layer and a top layer, and said forming said first filter and said second filter comprises, for each one of said first filter and said second filter, depositing an uncovered resonator deposited on top of said top layer and forming a buried resonator between said bottom layer and said top layer.

* * * * *